United States Patent [19]

Castagna et al.

[11] Patent Number: 4,690,081

[45] Date of Patent: Sep. 1, 1987

[54] SEWING MACHINE

[75] Inventors: Wolfgang Castagna; Jochen Krankenhagen; Heinz Ortwein; Klaus Weertz, all of Berlin, Fed. Rep. of Germany

[73] Assignee: awfi Arbeitswissenschaffliches Forschungsinstitut GmbH, Fed. Rep. of Germany

[21] Appl. No.: 808,518

[22] Filed: Dec. 13, 1985

Related U.S. Application Data

[63] Continuation-in-part of Ser. No. 522,840, Aug. 12, 1983, abandoned.

[51] Int. Cl.[4] ..... D05B 69/08

[52] U.S. Cl. ..... 112/276; 112/220; 112/221

[58] Field of Search ..... 112/220, 221, 276

[56] References Cited

U.S. PATENT DOCUMENTS

| | | | |
|---|---|---|---|
| 121,622 | 12/1871 | Hopkins | 112/220 |
| 306,288 | 10/1884 | Shaffer et al. | 112/221 X |
| 579,511 | 3/1897 | Biggar | 112/220 |
| 1,196,160 | 8/1916 | Schoolfield et al. | 112/220 |
| 3,541,982 | 11/1970 | Martorio | 112/276 |
| 3,812,801 | 5/1974 | Lukowicz | 112/276 |
| 3,977,339 | 8/1976 | Tice | 112/276 |
| 4,437,465 | 3/1984 | Nomoto et al. | 112/276 |

FOREIGN PATENT DOCUMENTS

| | | | |
|---|---|---|---|
| 620725 | 10/1935 | Fed. Rep. of Germany | 112/276 |
| 481,107 | 3/1979 | U.S.S.R. | 112/276 |

*Primary Examiner*—H. Hampton Hunter
*Attorney, Agent, or Firm*—John P. White

[57] ABSTRACT

A sewing system is proposed, which has a sewing head with thread tightener, a presser foot, a lower thread roll with a shuttle for guiding the lower thread and transport or transfer means for the further transporting of the workpiece to be processed. Separate drives are associated with these individual elements and these drives are synchronously controlled by a control device.

2 Claims, 8 Drawing Figures

SEWING MACHINE

Figure 1:
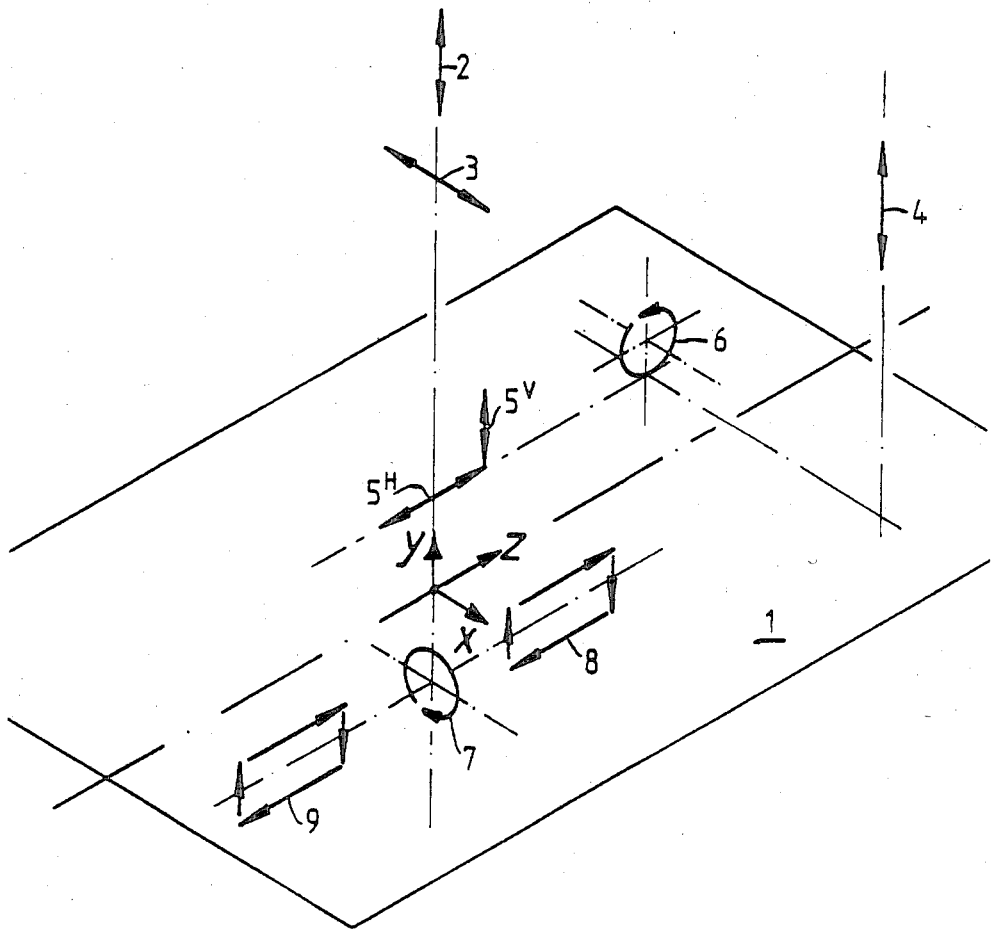

This application is a continuation-in-part of U.S. Ser. No. 522,840, filed Aug. 12, 1983, now abandoned, the contents of which are hereby incorporated by reference.

The present invention refers to a sewing device in accordance with the preamble to claim 1.

A sewing device of this type is already known from Federal Republic of Germany OS. No. 20 18 338. In that sewing device, the upper part of the needle drive unit is physically separated from the lower part with the bobbin or loop drive unit; no mechanical connecting members are present between upper part and lower part and the passage space for the sewing material is thus increased. In order to coordinate and synchronize the operation of the two drive units of the upper and lower parts of the sewing device, a plurality of electric control or regulating means are provided. With each drive unit of the upper and lower part there are, in their turn, associated a plurality of synchronized electric motor drives which displace the two drive units of the upper and lower part in synchronism along the X and Y axes, synchronized electric motor drives being, in addition, provided to turn the drive units of upper and lower parts in synchronism around the Z axis of the needle. In this connection the electric motor drives are, on the one hand, synchronized pairs of X and Y axis stepping-motor drives and, on the other hand, synchronized circumferential stepping motors with gear transmissions. The large number of electric drives required, as well as the expensive electric control or regulating devices resulting therefrom constitute a disadvantage.

From Federal Republic of Germany patent No. 10 11 265 there is also known a sewing device with electromagnetic drive in which the individual movements are effected by decentral electromagnets. The electromagnet for the needle drive is fed via a sawtooth generator and an upward and downward movement of the needle bar is produced via the armature. A corresponding electromagnetic drive is provided in the lower part of the sewing device for the movement necessary for zigzag sewing. These electromagnetic drives are, however, still not capable of assuring sufficient synchronism for oscillating movements within the frequency range necessary for a sewing device operating with high operating speed, since disturbing variables, such as residual magnetism, impair the precision. Such a sewing device, in particular, cannot satisfy the conditions of an industrial sewing device.

In the sewing device known from Federal Republic of Germany OS No. 29 18 460 the individual gear units are developed as modules which are connected in force- and/or form-locked manner With each other Via a central drive unit. This is merely a modified structural design of the traditional sewing device with only a single central drive, one particular advantage of the gear modules residing in the rapid convertibility. The structural size of this sewing device remains, however, in the same order of magnitude as previous sewing devices, due to the use of shafts, cams, drive belts and the like.

Similar disadvantages are present in the sewing device according to Federal Republic of Germany patent No. 29 03 031 which also has only a single drive unit which, via shafts, drive belts and the like, jointly drives the individual elements of the upper part and the lower part of the sewing device.

In all the above-described sewing devices known from the prior art, electric drives having the disadvantages indicated in each case are thus exclusively employed. In addition, sewing devices operated by compressed air are known from Federal Republic of Germany OS No. 30 18 892 and from U.S. Pat. No. 3,812,801. The sewing device for medical operations in accordance with Federal Republic of Germany 0S No. 30 18 892 is not a sewing device in the true sense, since only one needle motion mechanism is formed via pneumatic pistons. Further elements of a traditional sewing device are not present. The sewing device of U.S. Pat. No. 3,812,801 has a traditional electromechanical drive for the movement of the needle. From this, the zigzag movement of the swingable upper part of the sewing device is derived via a pneumatic attachment.

The sewing devices known from the prior art also have the substantial disadvantage that, with respect to their force transmission range the individual elements cannot be adapted to the type of material, the number of layers of material, the methods of manufacture selected or the like and changed in operating condition.

The object of the present invention is to optimize the degree of freedom of the individual elements in a sewing device of the above-mentioned type, particularly for manufacture in the garment industry, in order to be able to adapt, and change in operating condition, the force transmission ranges of the individual elements independently of each other to the type of material, the number of layers of material, the manufacturing method selected and the like and furthermore to keep the weight and volume of the drives as small as possible.

This object is achieved in a sewing device according to the preamble to claim 1 by means of the characteristic features set forth in that claim. With the sewing device of the invention, the drives of the individual elements can be controlled independently of each other within their force transmission ranges so that each individual element of the sewing device can be adapted and changed in operating condition to the type of material to be worked, the number of layers of material, the manufacturing methods selected, for instance the stitch geometry, and the like. For this purpose, each moving element of the sewing device has a separate hydraulic drive specifically tailored for said element, whereby a plurality of independent movements of the individual elements with respect to each other is possible. The courses of the movements of the individual elements are synchronously controlled and adapted to each other by means of the hydraulic pulse generator as control unit. Thus a central control of a plurality of sewing devices developed in accordance with the invention is also possible.

In view of the separate drives for each individual element of the sewing device, the individual elements such as sewing head, underthread roller, looper, transport means and the like can be positioned flexibly, independently of the other elements. Thus, for instance, a change in direction of a seam is possible without changing the position of the material to be worked. Thus three-dimensional sewing articles can be produced. By the arrangement of the individual elements and their separate drives a rapid change of the elements is possible, so that the sewing device can be converted rapidly to other manufacturing methods and a rapid change of different stitch geometries is possible.

Every sewing workplace can be optimally equipped, in accordance with the specific sewing task, with the sewing device of the invention since there is no impairment as a result of elements of the sewing device which are not required for the specific sewing work process.

It is particularly advantageous that the individual elements be driven directly without mechanical deflection of the direction of movement. Since each individual element has its own individual drive, precise adjustability of the required forces, for instance for different types of material, is possible. Since disturbing influences of moments of rotation are excluded, the operating output of the sewing device is rapidly reached, it being possible to reach, from the standpoint of the drive, large speed ranges, for instance numbers of strokes of the needle of $0.6 \cdot 10^4$/min. The individual drives can be adapted by construction to the different elements so that no unnecessary energy is consumed. Since flexible connecting lines can be used for the supplying of the individual drives (see claim 2), the individual elements have maximum freedom of positioning. Since mechanical parts are substantially superfluous, the sewing device is extremely quiet and vibrationless.

The sewing device of the invention can be provided with an intelligent control system whereby, for instance, the replacement of the needle and of the upperthread roller or the underthread roller can be controlled automatically independently of the material being worked or as a function of the desired type of stitch. By the use of the pulse hydraulics which operates in the frequency range of up to 50 kHz, it is possible, by suitable structural development, to produce weld connections by ultrasonics as well as cutouts such as buttonholes.

Figure 2:
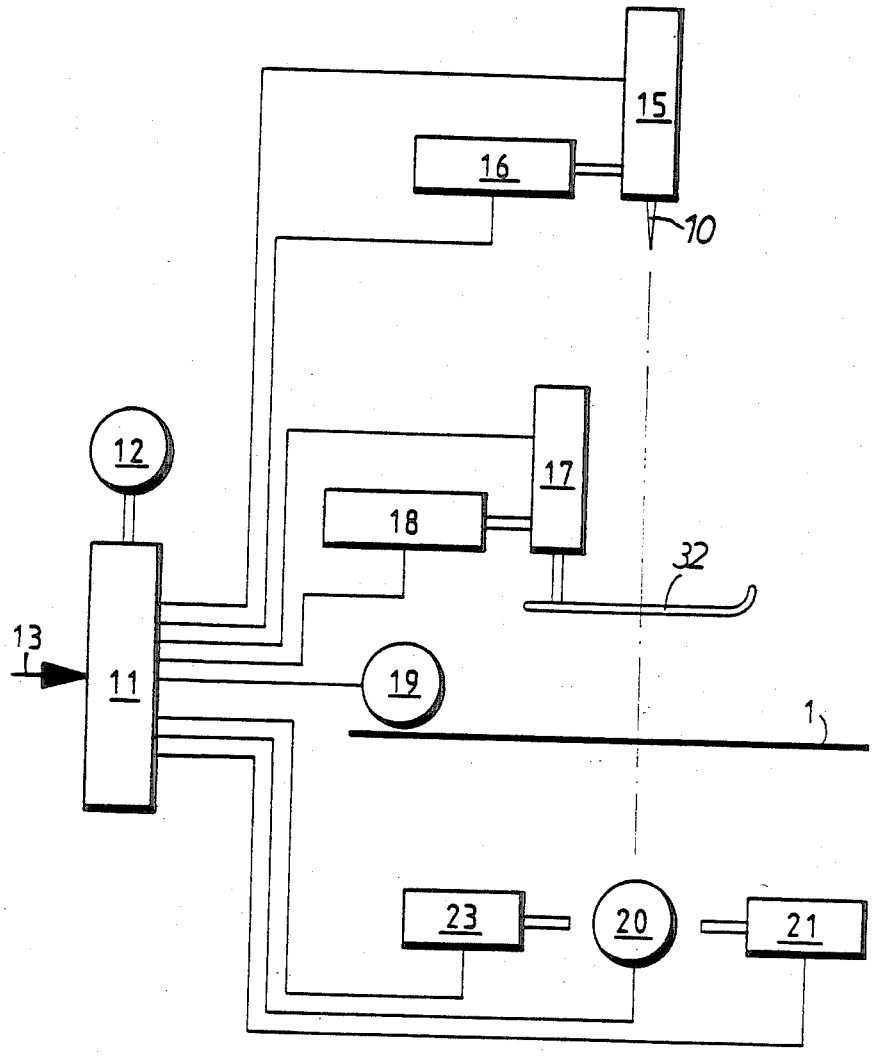
Figure 3:
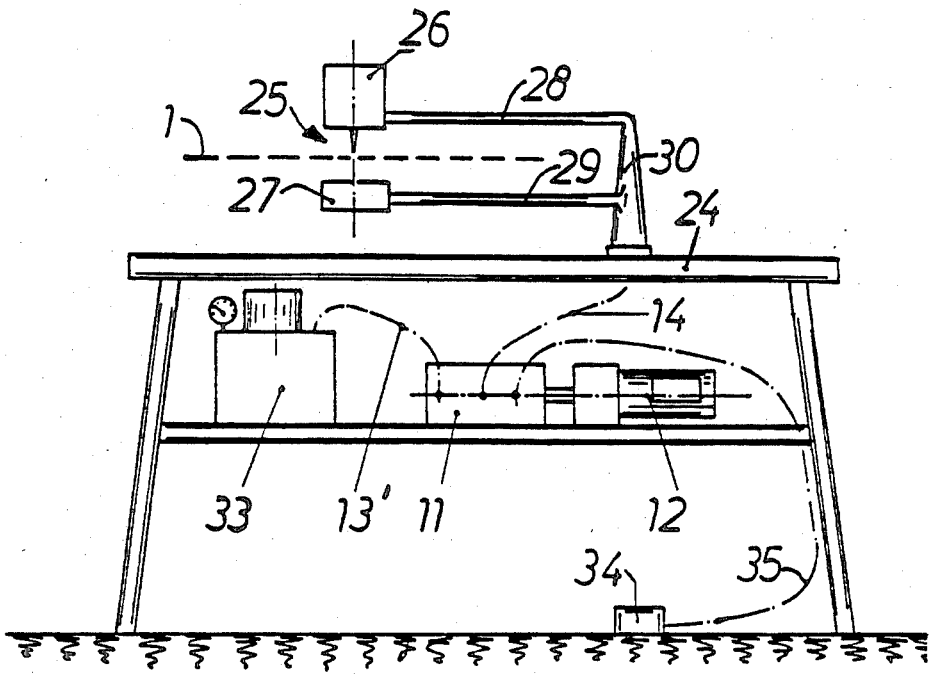
Figure 4:
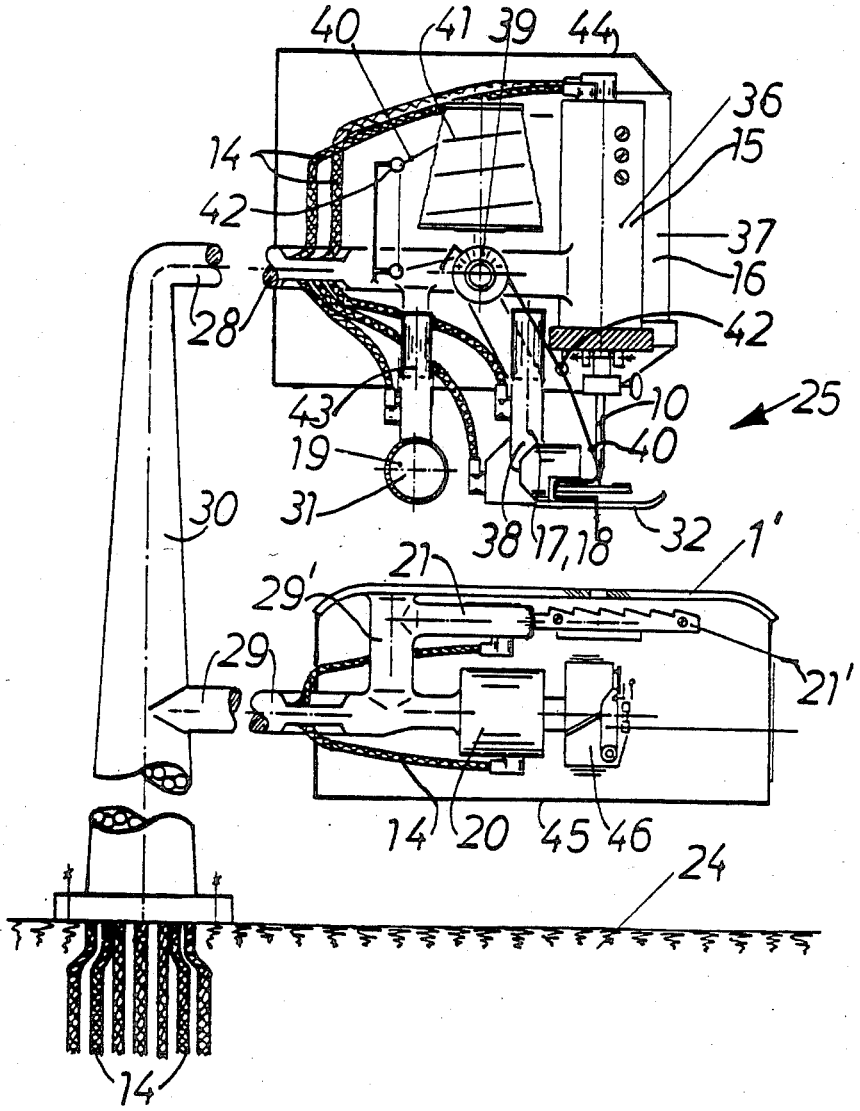
Figure 5:
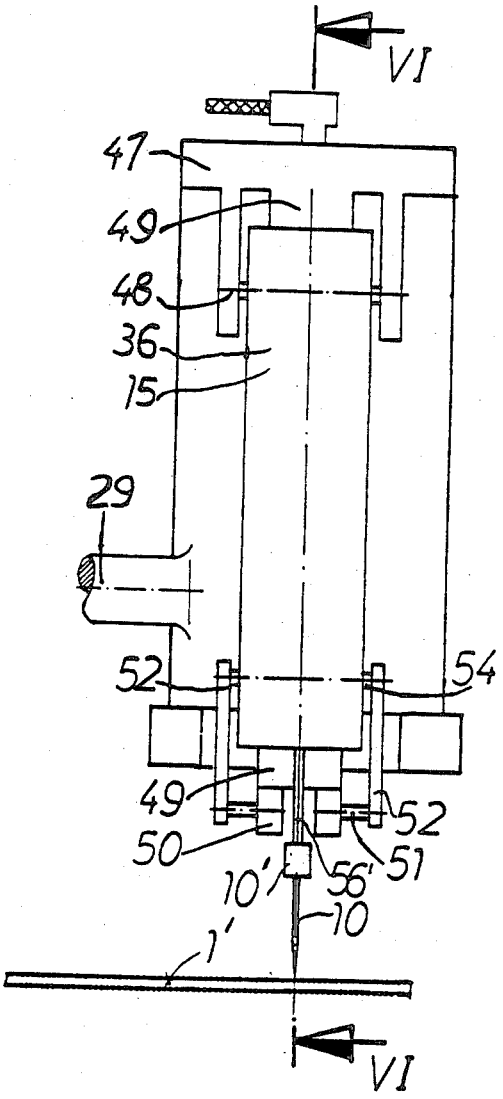
Figure 6:
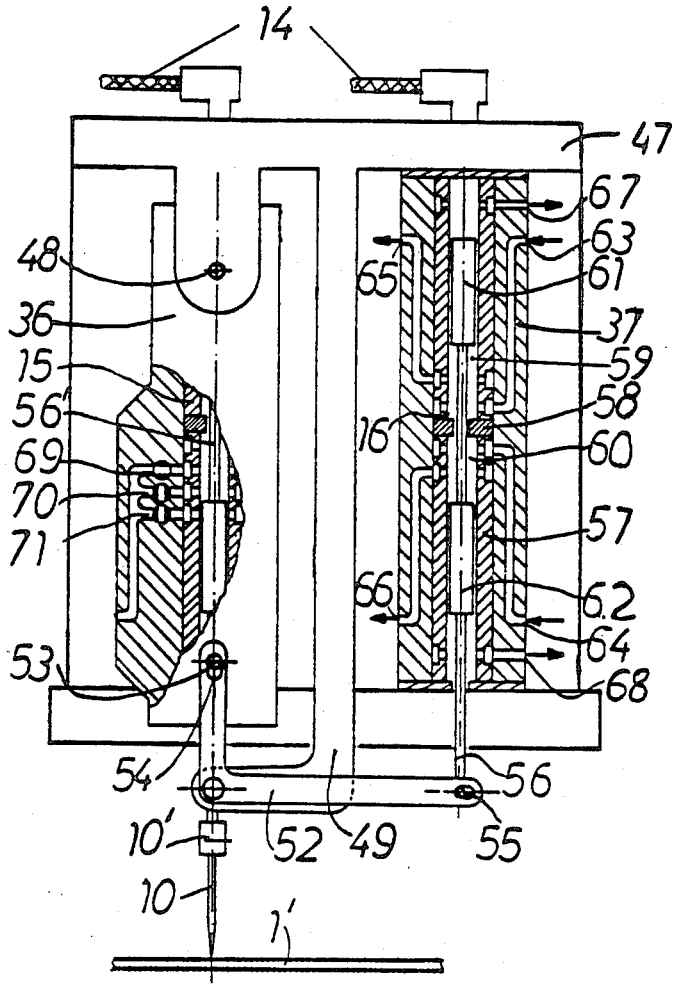
Figure 7:
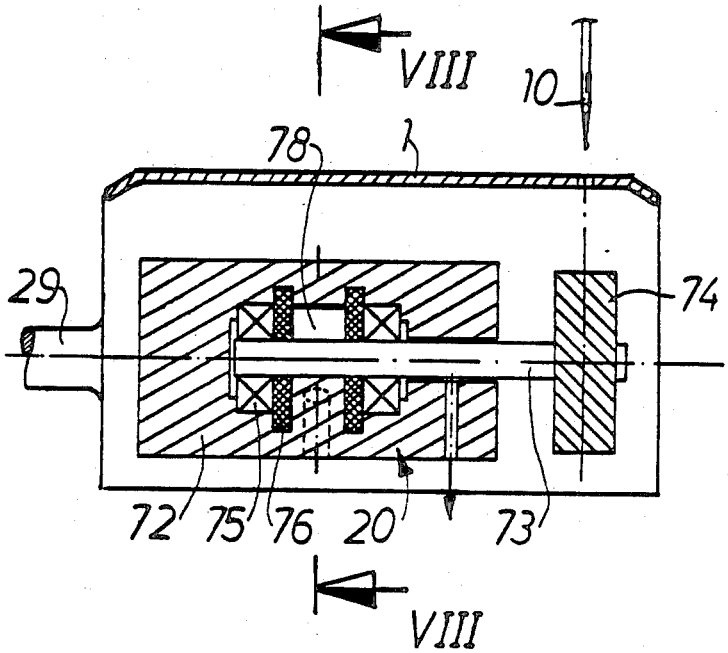
Figure 8:
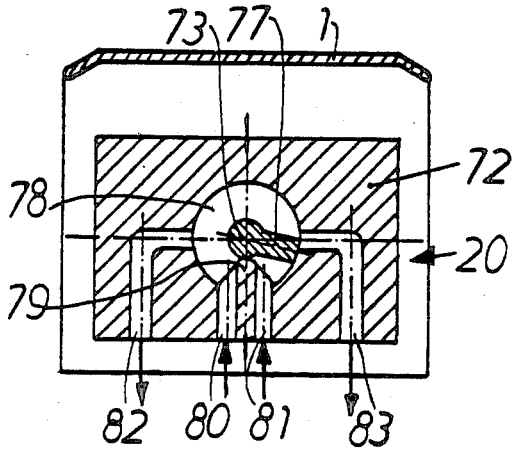

The sewing device of the invention is described in further detail below with reference to basic diagrams and a structural embodiment. In the drawing:

FIG. 1 shows the directions of movement of the individual elements of the sewing device, FIG. 2 shows, in diagrammatic form, the drives of the sewing device, FIG. 3 shows an embodiment of a sewing device in side view, FIG. 4 shows, on a larger scale, the sewing head of the sewing device of FIG. 3, FIG. 5 shows, on a larger scale, the needle drive of the sewing device according to FIGS. 3 and 4, FIG. 6 is a section along the line VI—VI through the sewing head of FIG. 5, FIG. 7 is an enlarged section through the lower part of the sewing head, and FIG. 8 is a section along the line VIII—VIII of FIG. 7 through the lower part of the sewing head.

In FIG. 1, the movements of the individual elements of the sewing device are shown by directional arrows which are arranged above and below the work plane 1 of the sewing device. The stroke movement 2 of the needle 10 takes place in the direction of the y-axis perpendicular to the work plane 1. The deflection movement 3 of the needle 10 transverse to the direction of sewing in accordance with the z-axis takes place parallel to the work plane 1 in the direction of the x-axis. The tensioning movement 4 for the upper thread 40 takes place perpendicular to the work plane 1. The presser-foot movements 5V and 5H take place perpendicular to the work plane 1 in the direction of the y-axis and parallel to the work surface 1 in the direction of the z-axis. The rotary movement 6 of a puller drive 19 takes place as additional transport movement for the sewing material. Below the work plane 1 there operates with the rotary movement 7 the looper drive 20 for the underthread 84, which is pulled by means of the looper drive 20 through the loop formed by means of the needle 10 from the upper thread 40. The rectangular movement 8 of a lower transport drive 21 behind the needle 10 and the rectangular movement 9 of a lower transport drive 23 in front of the needle 10 take place in each case in closed rectangular movements parallel to the work plane 1 and vertical to it respectively, i.e. in the direction of the y- and z-axes. The movements 2 to 9 shown characterize the maximum degree of freedom of the sewing device which is necessary for complex stitch geometries, for instance faggot stitch. The most frequent seam forms and stitch geometries, however, require only a partial region of the movements 2 to 9 shown.

The sewing process requires substantial synchronism of the individual movements 2 to 9. Corresponding to the specific sewing task, the individual movements 2 to 9 must take place synchronously in a predetermined ratio as a function of the stroke 2 of the needle 10, which serves as guide variable. In general, the ratio of the movements 2 to 9 of the elements with respect to each other can be indicated as follows:

The reciprocation 2 of the needle 10 corresponds to the movement of rotation 7 of the looper drive 20, the vertical presser-foot movement 5V, the horizontal presser-foot movement 5H, the tensioning movement 4 of the upperthread 40 and the rectangular movement 8 of the lower transport drive 21 behind the needle 10. To the upward and downward reciprocation 2 of the needle 10 there furthermore correspond the deflection movement 3 of the needle 10 which effects the zigzag movement, multiplied by a factor the rectangular movement of the lower transport drive in front of the needle 10, multiplied by another factor and the movement of rotation 6 of the puller drive 19 multiplied by still another factor, dependence on the diameter of the puller 31.

An individual drive 15 to 23 is provided for each of the above-indicated elements having the movements 2 to 9, so that the elements can be moved independently of each other. For the synchronizing of the individual drives 15 to 23 with each other a control device 11, 12, 33 is provided which may be of electronic or hydraulic construction. The drives 15 to 23 are adapted, by means of the control device 11, 12, 33, to the forces to be transmitted by the movements 2 to 9 of the individual elements, which forces are influenced as a function of the properties of the material, for instance the thickness and the material of the fabric and the manufacturing method selected, for instance the stitch geometry. In this connection, there is a large force transmission range for the upward and downward reciprocation 2 of the needle 10, depending on the number of layers of material and the types of material, for the rectangular movement 9 of the lower transport drive 23 in front of the needle 10, depending on the length and/or the weight of the sewing material to be sewn, and for the upper transport drive 23 formed on the upper presser foot 32. A small force transmission range is necessary for the tensioning movement 4 of the upper thread 40 by the bobbin case opener 39, the vertical presser-foot movement 5V, the rotary movement 7 of the looper drive 20, the zigzag movement-producing deflection movement 3 of the needle 10, the rectangular movement 8 of the lower transport drive 21 behind the needle 10, and the rectangular movement 6 of the puller drive 19.

FIG. 2 shows the control of the various individual drives by means of a hydraulic pulse generator 11 which is driven by an electric or hydraulic motor 12. The hydraulic pulse generator 11 converts a continuous hydraulic stream 13 fed to it into a plurality of pulsating hydraulic streams which flow in the lines 14 shown in FIG. 3. For the lines 14 flexible hose connections are used. The individual pulses fed to the drives 15 to 23 which are converted by the pulse generator 11 in accordance with the required speed of rotation are infinitely adjustable over a frequency range of 0 to 50 kHz and over any amplitude. The continuous flow of the hydraulic streams 13 can be produced either via a commercial hydraulic system decentrally for an individual sewing device or centrally for a plurality of sewing devices. The needle drive 15 effects the upward and downward reciprocation 2 of the needle 10 carried out perpendicular to the work plane 1 and is developed as a double-acting hydraulic cylinder. The drive 16 for the deflection 3 of the needle 10 which effects a zigzag movement is also developed as double-acting hydraulic cylinder. The deflection movement 3 of the needle 10 is effected via the zigzag drive 16, which is fastened on the housing for the needle drive 15. The zigzag drive 16 for the deflection movement 3 moves the needle drive 15 for the reciprocation 2 of the needle in accordance with the stitch geometry selected. By means of the presser drive 17, the vertical presser foot movement 5V takes place perpendicular to the work plane 1, the pressing-on of the presser foot 32 being effected by the hydraulic system pressure and the release of the pressure foot 32 by a spring. A single-acting cylinder is used for the presser drive 17. The presser drive 18 effects the horizontal presser-foot movement 5H for the upper transport drive 22 and is—in the same way as the transport drives 21 and 23 for the rectangular movements 8 and 9 of the underthread 84—developed as a double-acting hydraulic cylinder. For the puller drive 19, a hydraulic motor developed as stepping motor is provided. For the looper drive 20, a hydromotor for looper drive (step stitch) and a double-acting hydraulic cylinder for the looper movement (chain stitch) are used.

FIG. 3 shows one embodiment of the sewing device together with its drive elements, not all the drive elements, however, being shown. The pulse generator 11 and the electric or hydraulic motor 12 are mounted within a frame 24 and are connected directly to one another. The pulse generator 11 is connected via a control line 35 with a foot pedal 34 for the operating of the sewing device. Furthermore, the pulse generator 11 is connected via the plurality of hose lines 14 with the individual drives 15 to 23. Finally, the hydraulic stream 13 is fed from a hydraulic unit 33 via another hose line 13'.

Above the frame 24, there is the sewing head 25 which is formed of a sewing head upper part 26 and a sewing head lower part 27, between which the workplane 1 is located. The sewing head upper part 26 is fastened to an upper bracket arm 28. The sewing head lower part is fastened to a further, lower bracket arm 29. The two substantially horizontally extending bracket arms 28, 29 are arranged on a vertical stand 30 which is fastened on the upper workplate of the frame 24. The hose lines 14 to the individual drives 15 to 23 extend through the stand 30 and the bracket arms 28, 29.

FIG. 4 shows the sewing head 25, consisting of sewing head upper part 26 and sewing head lower part 27 according to FIG. 3, in a larger, more detailed view. In accordance therewith, on the end of the upper bracket arm 29 there is flanged a housing 36 which receives the needle drive 15 for the reciprocation 2 of the needle 10. In FIG. 4, behind the housing 36 there is shown the housing 37 which receives the zigzag drive 16 for the deflection motion 3 of the needle 10. The hoses 14 leading to the hydraulic drives 15, 16 are fed within the stand 30 and the upper bracket arm 28 and emerge from it in order to be introduced from above into the housings 36, 37.

Below the needle 10 there extends the presser foot 32, whose presser foot drives 17, 18 are in a housing 38 which is flanged to the bottom of the upper bracket arm 28. Further hoses 14 are conducted to the presser foot drives 17, 18 arranged in the housing 38.

Above the housing 38 for the hydraulic presser foot drives 17, 18 a bobbin case opener 39 which effects the tensioning movement 4 for the upper thread 40 is mounted on the upper bracket arm 28. The upper thread is fed from a thread bobbin 41, via guide eyes 42 and the bobbin case opener 39 as well as another guide eye 42, to the needle 10.

Below the thread bobbin 41 and below the upper bracket arm 28, the puller drive 19 for the puller 31 is mounted within a housing 43. Another hydraulic line 14 is conducted to the hydraulic puller drive 19. The hydraulic puller drive 19 actuates the puller 31 for the rotary movement 6 as additional transport movement of the sewing material.

The housings 36, 37 for the hydraulic needle drives 15, 16, the thread bobbin 41 and parts of the housings 48 and 43 for the hydraulic presser foot drive 17 and the hydraulic puller drive 19 are arranged within a box-like cover 44, which thus encloses the entire sewing head upper part 26.

The sewing head bottom part 27 is enclosed in another cover 45 which is located below the work plane 1 formed of a work plate 1' for the supporting of the sewing material. Below the work plate 1' there is provided on a vertical extension 29' of the lower bracket arm 29, the hydraulic transport drive 21 for the lower transport device behind the needle. For the transport drive 21, a hose 14 is conducted through the lower bracket arm 29. On the free end of the lower bracket arm the hydraulic looper drive 20 for the underthread looper 46 is seated.

In FIGS. 5 and 6 the hydraulic needle drives 15, 16 for the reciprocation 2 and deflection movement 3 respectively of the needle 10 are shown. The housing 37 for the zigzag drive 16 is arranged firmly on the upper bracket arm 28. On the housing 37 there is arranged a swing frame 47 for a swivel shaft 48 in which the housing 36 for the needle drive 15 is swingably mounted. Between the two housings 36 and 37 an L-shaped support 49 is fastened to the swing frame 47 and L-shaped support 49 is provided in its lower part with two horizontal extensions 50 which are spaced apart from each other and between which the needle 10 is freely guided. The two extensions 50 bear on their outer sides stub shafts 51 on which two bell crank levers 52 are swingably mounted. The vertical arms of the bell crank levers 52 are provided at their ends with slots 53 into which there extend pins 54 which are arranged fixed in position on the outside of the housing 36 of the needle drive 15. The horizontal arms of the bell cranks levers 52 also have slots 55 into which a swivel shaft is engaged which is arranged on the free end of the piston rod 56 of the hydraulic zigzag drive 16.

The hydraulic zigzag drive 16 is formed by a double-acting hydraulic cylinder 57 whose cylindrical space is divided by a sealing disk 58 into two chambers 59, 60. Within each chamber a piston 61, 62 is arranged on the piston rod 56 which passes through it. Each chamber 59, 60 has an inlet port 63, 64 and an outlet port 65, 66.

A leakage oil port 67, 68 lies on each rear side of each piston 61, 62.

The double-acting hydraulic cylinder 57 described operates as follows:

Upon the entrance of pressure oil into the inlet port 63, the output port 65 associated with the upper chamber 59 is closed. At the same time, the input port 64 associated with the lower chamber 60 is closed, but the associated outlet port 66 is opened. In this way, under the action of the pressure oil flowing into the upper chamber 59 the piston 61 and thus the piston rod 56 are raised. The bell crank lever 52 is swung in counter-clockwise direction. The housing 36 of the needle drive 15 is swung to the left around the swivel pin 48 (FIG. 6), as a result of which the needle 10 is deflected to the left (x-axis). At the same time, the pressure oil is forced out of the chamber 60 by the piston 62 through the output port 66 until the upper edge of the piston 62, as control edge, closes off the outlet port 66. The pressure oil then still present in the chamber 60 serves as buffer. Pressure oil is now fed through the inlet port 64 to the lower chamber 60, and the outlet port 66 of the lower chamber is closed. At the same time, the outlet port of the upper chamber 59 is opened and the inlet port 63 associated with it is closed. The piston 62 moves downward under the action of the pressure which builds up in the chamber 60 and at the same time, under the action of the upper piston 61, the pressure oil is forced out of the chamber 59 through the outlet port 65 until the latter is closed by the con edge of the upper piston 61. In this way, the bell crank 52 is swung in clockwise direction, i.e. the needle is deflected to the right (in FIG. 6). By this right-left deflection of the needle 10, the desired zigzag movement of needle 10 is produced. Through the corresponding leakage-oil ports 67, 68 the spaces lying on the rear of the pistons 61, 62 are vented and any leakage oil present is led off here.

The needle drive 15 for reciprocation 2, which drive is arranged in the 36, operates in the same way with respect to the vertical upward and downward movement of the piston rod 56' as the hydraulic zigzag drive 16 for the deflection movement 3. In this way the desired vertical upward and downward movement of the needle 10 is produced, the needle being fastened to the lower end of the piston rod 56' via a needle mount 10'. To be sure, in the case of the zigzag drive 16 a stroke height adjustment is provided for the needle 10, constructed as follows: The outlet port 66 comprises three outlet ports 69 to 71 each of which leads out of the lower chamber 60 and which are provided with shut-off valves. In the embodiment shown, the shut-off valve of the upper outlet port 69 is open, while the shut-off valves of the other outlet ports 70, 71 are closed. Thus, upon the upward movement of the piston 62, a pressure cushion is formed only when the outlet port 69 is reached by the control edge of the piston 62. The needle 10 carries out a maximum stroke movement. If the shut-off valve of the upper outlet port 69 is closed and the shut-off valve of the lower outlet port 71 opened, the pressure cushion is built up already when the control edge of the piston 62 reaches the outlet port 71, so that the needle 10 can only carry out a minimum stroke movement.

All inlet ports 63, 64, outlet ports 65, 66 and outlet ports 69, 71 are connected to the hydraulic control device by corresponding hoses 14.

FIGS. 7 and 8 show the looper drive 20 for the underthread looper 46. The transport drive 21 is not shown here since the same operating principle is used as in the case of the drives 15, 16 of the needle 10. The looper drive 20 has a housing 72 which is firmly connected to the lower bracket arm 29. Within the housing 72 there is mounted a horizontally arranged shaft 73 which bears at its free end, the underthread bobbin 74 which is developed in traditional manner and is arranged below the needle 10. The shaft 73 has, between its supports 75, two sealing disks 76 between which there is arranged a swing vane 77 which is rigidly connected to the shaft 73. The swing vane 77 is mounted, sealed off on all sides, within a housing opening 78 of circular cross section, the lateral sealing being effected by the sealing disks 76. As shown in FIG. 8, the housing opening 78 has on its bottom side a ridge-shaped nose 79 which rests in sealed manner against the shaft 73. On both sides of the sealing point, inlet ports 80, 81 are developed. In the central plane, at the 90° and 270° positions of the swing vane 77, outlet ports 82, 83 are connected to the housing opening 78.

The looper drive 20 described for the underthread looper 74 operates as follows:

Upon the feeding of pressure oil through the inlet port 81, with the inlet port 80 closed and the outlet port 83 closed, a pressure-oil cushion is built up below the swing vane 77 so that the latter is swung in counter-clockwise direction until its leading control edge closes off the outlet port 82. An oil cushion is built up in this case below the swing vane 77 so that the latter comes to a stop. The control is now reversed in the manner that the inlet port 80 is opened and the outlet port 81 is closed. At the same time, the outlet port 83 is opened and the outlet port 82 is closed. Under the action of the pressure oil cushion which now builds up below the swing vane 77, the swing vane 77 is swung back in clockwise direction until its leading control edge closes the outlet port 83. In this way, the underthread bobbin 74 is cyclically swung. The feeding and removal of the pressure oil to and from the ports 80, 81 and outlet ports 82, 83 is effected, controlled by the control device, by means of the connected pressure-oil hose 14.

The presser foot drives 17, 18 and the transport drives 21 to 23 are developed in the same manner as the needle drives 15, 16 and looper drive 20 described in detail above. The puller drive 19 is developed as a known hydromotor. The control lines shown for the pressure oil have been shown only in principle. As the specific embodiments in accordance with FIGS. 5 to 8 show, actually the number of flexible hose lines 14 which are conducted to the individual drives 15 to 23 is much larger.

The development of the individual hydraulic drives 15 to 23 makes it possible synchronously to control the individual movements via the pulse generator 11 from the control device 11, 12, 33 separately from each other via separate lines 14 so that the separate drives 15 to 23 can be adapted as desired to the forces and/or speeds to be transmitted by them.

We claim:

1. A sewing device having a sewing head with thread tensioner, a presser foot, an underthread roller with a looper for guiding the underthread, transport means for the advancing of the workpiece to be handled and a plurality of drives, characterized in that:

(a) each individual element has its separate drive (15 to 23) in the form of hydromotors or hydropistons;

(b) the separate drives (15 to 23) are connected via lines (14) with a hydraulic pulse generator (11) driven by an electric or hydraulic motor (12) and can be controlled synchronously by said generator;

(c) the hydraulic stream (13) which is continously fed to the pulse generator (11) is transformed into a plurality of hydraulic streams which are fed separately, via the lines (14), to the individual drives (15 to 23), pulsate and are infinitely adjustable in their frequency range; and (d) the separate drives (15 to 23) of the individual elements are adapted to the forces of speeds to be transmitted by the latter.

2. A sewing device according to claim 1, characterized by the fact that the supplying of the separate drives (15 to 23) is effected via flexible connecting lines (14).

* * * * *